US009471007B2

(12) United States Patent
Kawarago

(10) Patent No.: US 9,471,007 B2
(45) Date of Patent: Oct. 18, 2016

(54) DEVELOPER SUPPLY CARTRIDGE SHUTTER OPENING PROJECTION THAT MOVES IN TWO DIRECTIONS

(71) Applicant: CANON KABUSHIKI KAISHA, Tokyo (JP)

(72) Inventor: Atsushi Kawarago, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/284,438

(22) Filed: May 22, 2014

(65) Prior Publication Data

US 2014/0348548 A1 Nov. 27, 2014

(30) Foreign Application Priority Data

May 27, 2013 (JP) ..... 2013-110783

(51) Int. Cl.
*G03G 15/08* (2006.01)

(52) U.S. Cl.
CPC ..... *G03G 15/0886* (2013.01)

(58) Field of Classification Search
CPC ..... G03G 15/0886
USPC ..... 399/120, 260
See application file for complete search history.

(56) References Cited

U.S. PATENT DOCUMENTS 6,785,497 B1 * 8/2004 Hasebe ..... G03G 15/0872 222/DIG. 1
2006/0133856 A1 * 6/2006 Deguchi et al. ..... 399/262
2007/0248384 A1 * 10/2007 Kawai ..... G03G 15/0886 399/260
2014/0376972 A1 * 12/2014 Kawarago ..... 399/260

FOREIGN PATENT DOCUMENTS

JP 2011-242528 A 12/2011

OTHER PUBLICATIONS

Co-pending U.S. Appl. No. 14/313,307.

* cited by examiner

*Primary Examiner* — Benjamin Schmitt
*Assistant Examiner* — Matthew Miller
(74) *Attorney, Agent, or Firm* — Fitzpatrick, Cella, Harper & Scinto

(57) ABSTRACT

A developer container includes an accommodating portion accommodating developer and is provided with an opening, a shutter member for opening and closing the opening, a projection for moving the shutter member, and a guiding portion for guiding the projection. When the projection is pushed in a pushing direction, the projection is moved in a direction different from the pushing direction by being guided by the guiding portion in contact with the guiding portion and thereafter is moved in the pushing direction, thereby to move the shutter member to open the opening.

12 Claims, 5 Drawing Sheets

(a)

(b)

DEVELOPER SUPPLY CARTRIDGE SHUTTER OPENING PROJECTION THAT MOVES IN TWO DIRECTIONS

FIELD OF THE INVENTION AND RELATED ART

The present invention relates to a developer container, a developing device, a developer supply cartridge, a drum container and an image forming apparatus.

In a conventional image forming apparatus such as a printer, a constitution in which a toner image (developer image) on a photosensitive drum (image bearing member) is transferred onto a sheet has been used. Further, in order to improve a maintenance property and usability, the photosensitive drum and a process means actable on the photosensitive drum are integrally assembled into a cartridge (unit) detachably mountable to an image forming apparatus main assembly, and the cartridge has been used. The cartridge is constituted, in some cases, by two members consisting of a drum container containing the photosensitive drum and a toner container for supplying a toner (developer) to the drum container. These drum container and toner container are detachably mountable to each other. Further, in some cases, a toner collecting container is provided separately from the cartridge in order to collect the developer remaining on the photosensitive drum after transfer of the toner image. Each of the containers for transferring the developer is provided with a shutter member at a toner feeding path opening. Further, when the containers are mounted in the apparatus main assembly, the shutter members are opened to form a toner feeding path, and when the containers are demounted from the apparatus main assembly, the shutter members are closed to block the toner feeding path, thus preventing toner leakage or the like. Particularly, in recent years, the improvements in maintenance property and usability are required more than ever before, so that leakage prevention by the shutter members is increasingly needed. Therefore, Japanese Laid-Open Patent Application (JP-A) 2011-242528 proposes a constitution in which a shape of the shutter members is devised to enhance a sealing property.

Further, for example, a constitution in which an elastic portion for enhancing the sealing property is gradually compressed from end portions toward a central portion during a closing operation of the shutter member provided on the toner container to realize a smooth operation of the shutter member and prevention of deformation of the elastic portion, thus suppressing a lowering in sealing property. By employing such a constitution, it becomes possible to provide the toner container including the shutter member with a high sealing property.

Further, an example of a conventional shutter constitution will be described with reference to (a) to (d) of FIG. 5. In FIG. 5, (a) is a schematic partial sectional view showing a closed state of a shutter of a conventional toner container 100, (b) is a schematic partial bottom view showing the closed state of the shutter of the conventional toner container 100, (c) is a schematic partial sectional view showing an open state of the shutter of the conventional toner container 100, and (d) is a schematic partial bottom view showing the open state of the shutter of the conventional toner container 100.

In (a) and (b) of FIG. 5, a toner supply opening 100*a* is provided at a lower portion of the toner container 100, and a toner supply opening shutter (shutter member) 100*b* is provided at a lower surface of the toner supply opening 100*a*. The toner supply opening shutter 100*b* is held movably in an arrow G direction in (a) of FIG. 5. Further, before the toner container 100 is mounted in an apparatus main assembly, the toner supply opening shutter 100*b* is urged and held at a position (shown in (a) and (b) of FIG. 5), where the toner supply opening shutter 100*b* covers (blocks) the toner supply opening 100*a*, by a toner supply opening shutter spring 100*c*. In this way, the toner supply opening shutter member 100*b* prevents the toner from leaking out through the toner supply opening 100*a* in a non-mounted state of the toner container 100 in the apparatus main assembly.

On the other hand, as shown in (c) and (d) of FIG. 5, in the state in which the toner container 100 is mounted in the apparatus main assembly, the contact portion provided in the apparatus main assembly side, the drum container side or the like urges the toner supply opening shutter 100*b* in an arrow H direction in the figures to perform an opening operation. Then, the toner feeding path from the toner supply opening 100*a* is formed.

Here, when the toner container 100 is demounted from the apparatus main assembly and then is carried, e.g., in the case where a user access the shutter or in the case where the user erroneously drops the container, there is the case where a force is applied to the shutter. Further, a force-applied direction coincides with an opening operation direction of the shutter (the arrow H direction in (c) and (d) of FIG. 5), there was a fear that the shutter was opened and thus the toner was leaked out.

SUMMARY OF THE INVENTION

In view of the above problem, a principal object of the present invention is to provide a developer container having a shutter constitution capable of suppressing leakage of a toner.

According to an aspect of the present invention, there is provided a developer container comprising: an accommodating portion accommodating a developer and being provided with an opening through which the developer is passable; a shutter member for opening and closing the opening; a projection for moving the shutter member; and a guiding portion for guiding the projection, wherein when said projection is pushed in a pushing direction, the projection is moved in a direction different from the pushing direction by being guided by the guiding portion in contact with the guiding portion and thereafter is moved in the pushing direction, thereby to move the shutter member to open the opening.

According to another aspect of the present invention, there is provided a developing device detachably mountable to a main assembly of an image forming apparatus, comprising: the developer container described above, wherein the developer is supplied from a developer supply cartridge having a contact portion for pushing the projection in contact with the projection.

According to another aspect of the present invention, there is provided a developer supply cartridge detachably mountable to a main assembly of an image forming apparatus, comprising: the developer container described above, wherein the accommodated developer is supplied to a developing device having a contact portion for pushing the projection in contact with the projection.

According to another aspect of the present invention, there is provided a process cartridge detachably mountable to a main assembly of an image forming apparatus, comprising: process means for performing an image forming process; an image bearing member for bearing a latent image; and the developer container described above.

According to a further aspect of the present invention, there is provided an image forming apparatus for forming an image on a recording material with a developer, comprising: an image bearing member for bearing a latent image; and the above-described developer container detachably mountable to the image forming apparatus.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, unless otherwise specified, the scope of the present invention is not intended to be limited thereto.

Figure 1:
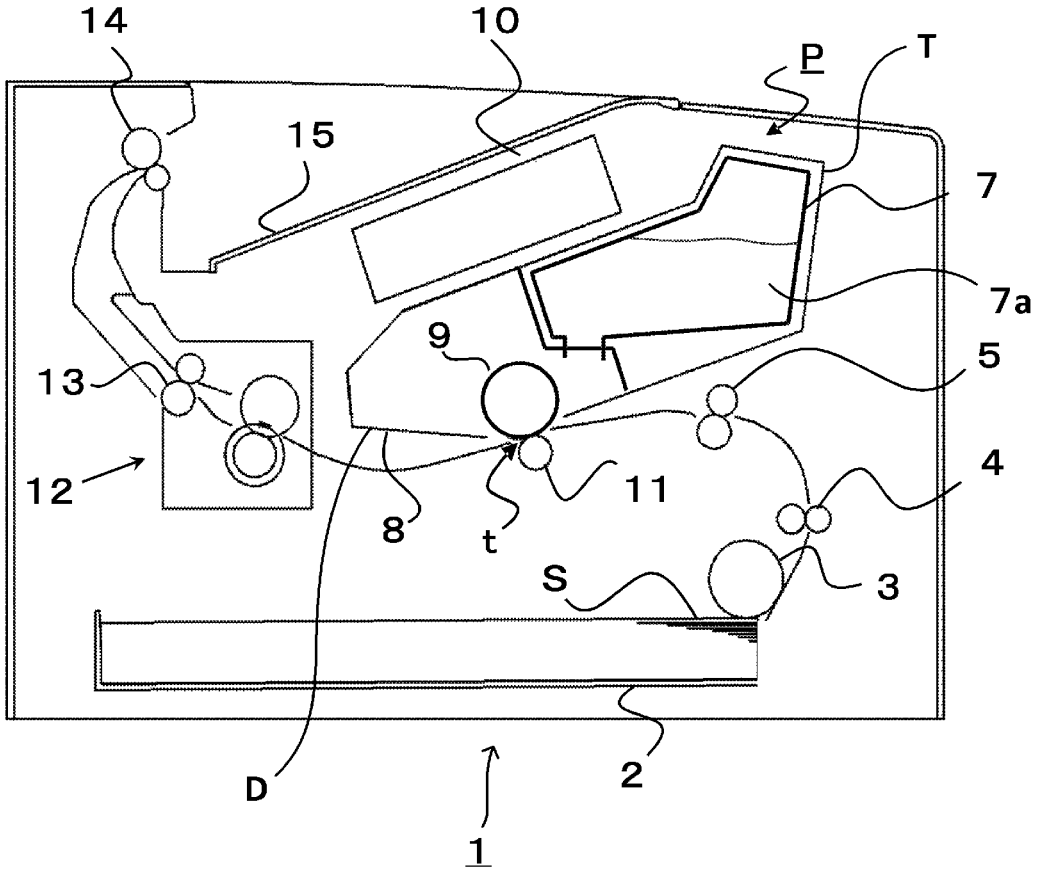
FIG. 1 is a schematic sectional view showing an image forming apparatus according to an embodiment.

First, with reference to FIG. 1, a general structure of an image forming apparatus according to an embodiment of the present invention will be described, FIG. 1 is a schematic sectional view showing an image forming apparatus in this embodiment. As shown in FIG. 1, the image forming apparatus in this embodiment includes a sheet feeding cassette 2, a sheet feeding roller 3, conveyor roller pairs 4 and 5, a laser scanner 10, a transfer roller 11, a fixing device 12, conveyor roller pairs 13 and 14, a discharge portion 15 and a contact P. The process cartridge P includes a drum 9 as an image bearing member and various process means, actable on the drum 9, for performing an image forming process.

The process cartridge P is detachably mountable to an image forming apparatus main assembly 1 and is constituted by a toner supply cartridge T including a toner container (developer container) 7 and a developing device D including a drum container 8 provided with the drum 9. In an accommodating portion 7*a* constituted by a frame constituting the toner container 7, a toner as a developer is accommodated.

In the developing device D, the toner is accommodated, and a developing process is carried out by using the accommodated toner. Then, when the toner accommodated in the developing device D becomes small in amount, the toner is supplied from the toner supply cartridge T as a developer supply cartridge. Further, the toner supply cartridge T and the developing device D are constituted so as to be detachably mountable to each other. By employing such a constitution, in the case where a remaining amount of the toner accommodated in the process cartridge P is small, by exchanging only the toner supply cartridge T, the toner can be supplied (replenished).

Further, with reference to FIG. 1, in the image forming apparatus according to this embodiment, a brief explanation of a process from sheet feeding until an image is formed on a sheet S and the sheet S is discharged will be made. First, the sheet S as a recording material stacked in the sheet feeding cassette 2 detachably mountable to the apparatus main assembly 1 is separated and fed one by one by the sheet feeding roller 3, and then is conveyed to a transfer portion t by the conveyor roller pairs 4 and 5. Here, the transfer portion t is a part, of a surface of the drum 9, where the drum 9 opposes a transfer roller 11.

On the other hand, on the drum 9 provided in the drum container 8, a latent image is formed by laser light emitted from the laser scanner 10. Then, the latent image is developed with the toner supplied from the toner container 7 and then accommodated in the drum container 8, so that a toner image as a developer image is formed on the drum 9. Onto the sheet S, the toner image is transferred at the transfer portion t by the transfer roller 11, and then the sheet S is conveyed to the fixing device 12. The sheet S conveyed to the fixing device 12 is heated and pressed, so that the toner image is fixed thereon and then the sheet S is discharged onto the discharge portion 15 by the conveyor roller pairs 13 and 14.

Figure 2:
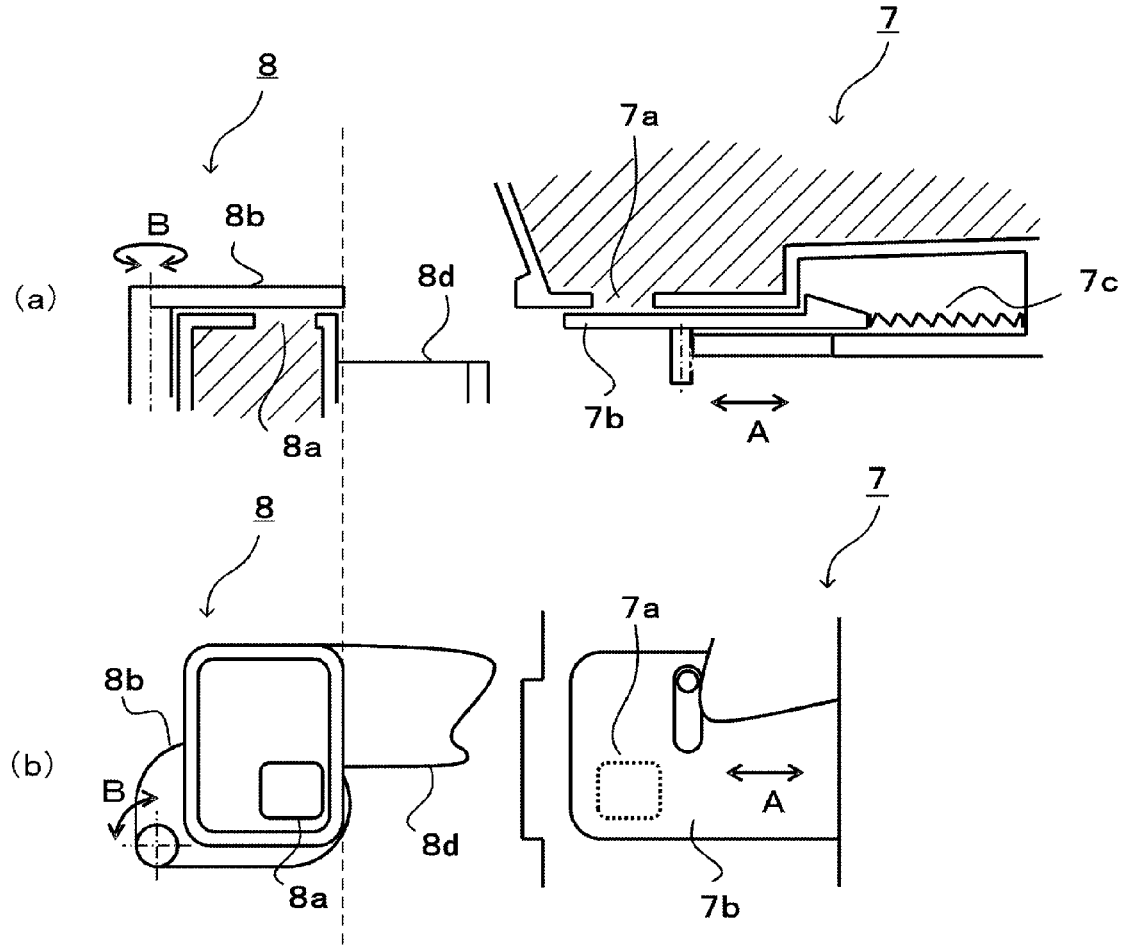
In FIG. 2 is (a) and (b) are schematic views showing a non-mounted state of a toner container according to the embodiment.

Next, with reference to FIG. 2, a shutter constitution (structure) of each of the toner container 7 and the drum container 8. In FIG. 2, is (a) and (b) are schematic views each showing a non-mounted state of the toner container 7 in this embodiment. In FIG. 2, (a) is a schematic partial sectional view showing the non-mounted state of the toner container 7, and (b) is a schematic partial bottom view showing the non-mounted state of the toner container 7. In these figures, an arrow A direction is a direction such that the toner container 7 is mounted onto and demounted from the drum container 8. Further, a state in which the toner container 7 is mounted to a predetermined position relative to the drum container 8 is referred to a mounted state, and a state in which the toner container 7 is not mounted to the drum container 8 is referred to as the non-mounted state.

As shown in (a) and (b) of FIG. 2, at a lower portion of the toner container 7, a toner container supply opening 7*a* as an opening through which the toner is passable is provided. Further, at a lower surface of the toner container supply opening 7*a*, a toner container shutter 7*b* as a shutter member capable of opening and closing the toner container supply opening 7*a* is provided. The toner container shutter 7*b* is held movably in the arrow A direction in the figures, and before the toner container 7 is mounted on the drum container 8, the toner container shutter 7*b* is urged and held by a toner container shutter spring 7*c* at a blocking (covering) position of the toner container supply opening 7*a* as shown in (a) of FIG. 2. In this way, in the non-mounted state, the toner container shutter 7*b* prevents the toner from leaking out through the toner container supply opening 7*a*.

On the other hand, at an upper portion of the drum container 8, a drum container (toner) receiving opening 8*a* is provided, and at an upper surface of the drum container receiving opening 8*a*, a drum container shutter 8*b* is provided. The drum container shutter 8*b* is held movably in an arrow B direction in the figures, and before the toner container 7 is mounted on the drum container 8, the drum container shutter 8*b* is urged and held by an unshown urging means at a blocking (covering) position of the toner container supply opening 7*a* as shown in (a) and (b) of FIG. 2. In this way, in the non-mounted state, the drum container shutter 8*b* prevents the toner in the drum container 8 from leaking out through the drum container receiving opening 8*a*.

Figure 3:
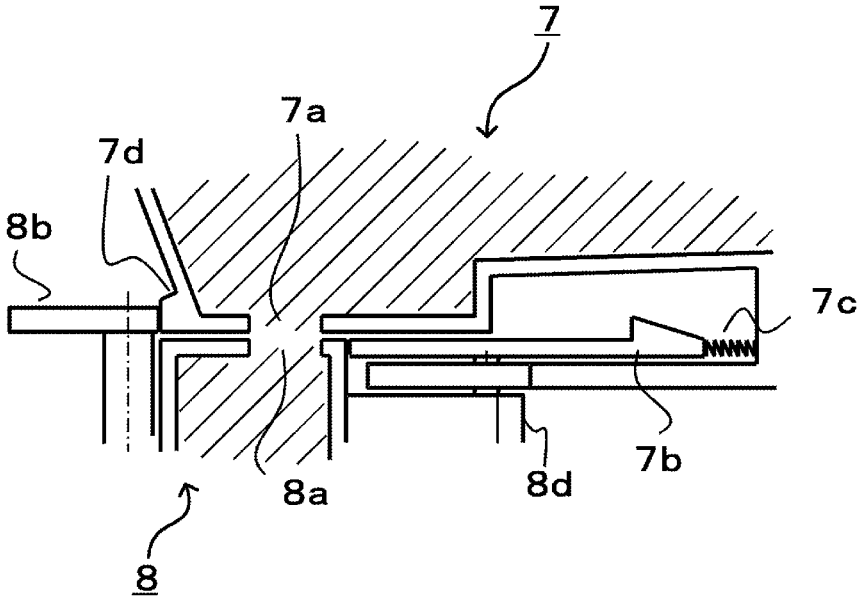
In FIG. 3, (a) and (b) are schematic views showing a mounted state of the toner container according to the embodiment.
Figure 3:
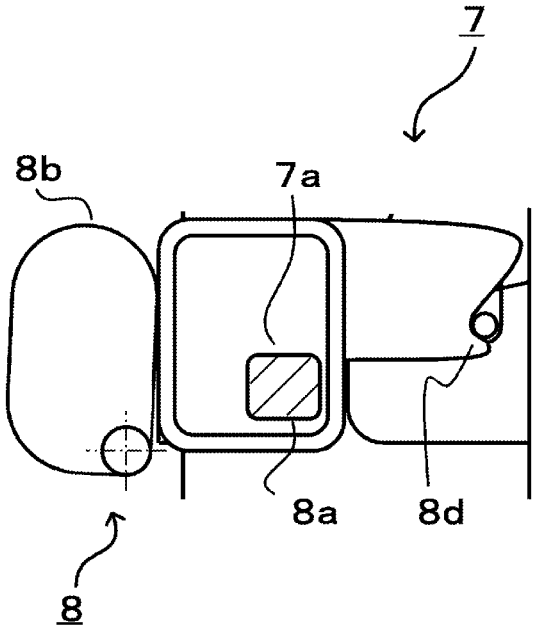

Next, with reference to FIG. 3, a toner feeding path from the toner container 7 to the drum container 8 will be described. In FIG. 3, (a) and (b) are schematic views each showing the mounted state of the toner container 7 in this embodiment. In FIG. 2, (a) is a schematic partial sectional view showing the mounted state of the toner container 7, and (b) is a schematic partial bottom view showing the mounted state of the toner container 7.

As shown in (a) and (b) of FIG. 3, in the state in which the toner container 7 is mounted on the drum container 8, by an operation described later, a shutter contact portion 7*d* provided on the toner container 7 performs an opening operation of the drum container shutter 8*b*. On the other hand, a shutter contact rib (contact portion) 8*d* provided on the drum container 8 performs an opening operation of the toner container shutter 7*b*. By these operations, the toner feeding path from the toner container supply opening 7*a* to the drum container receiving opening 8*a* is formed, so that the toner is to be supplied from the toner container 7 into the drum container 8.

Figure 4:
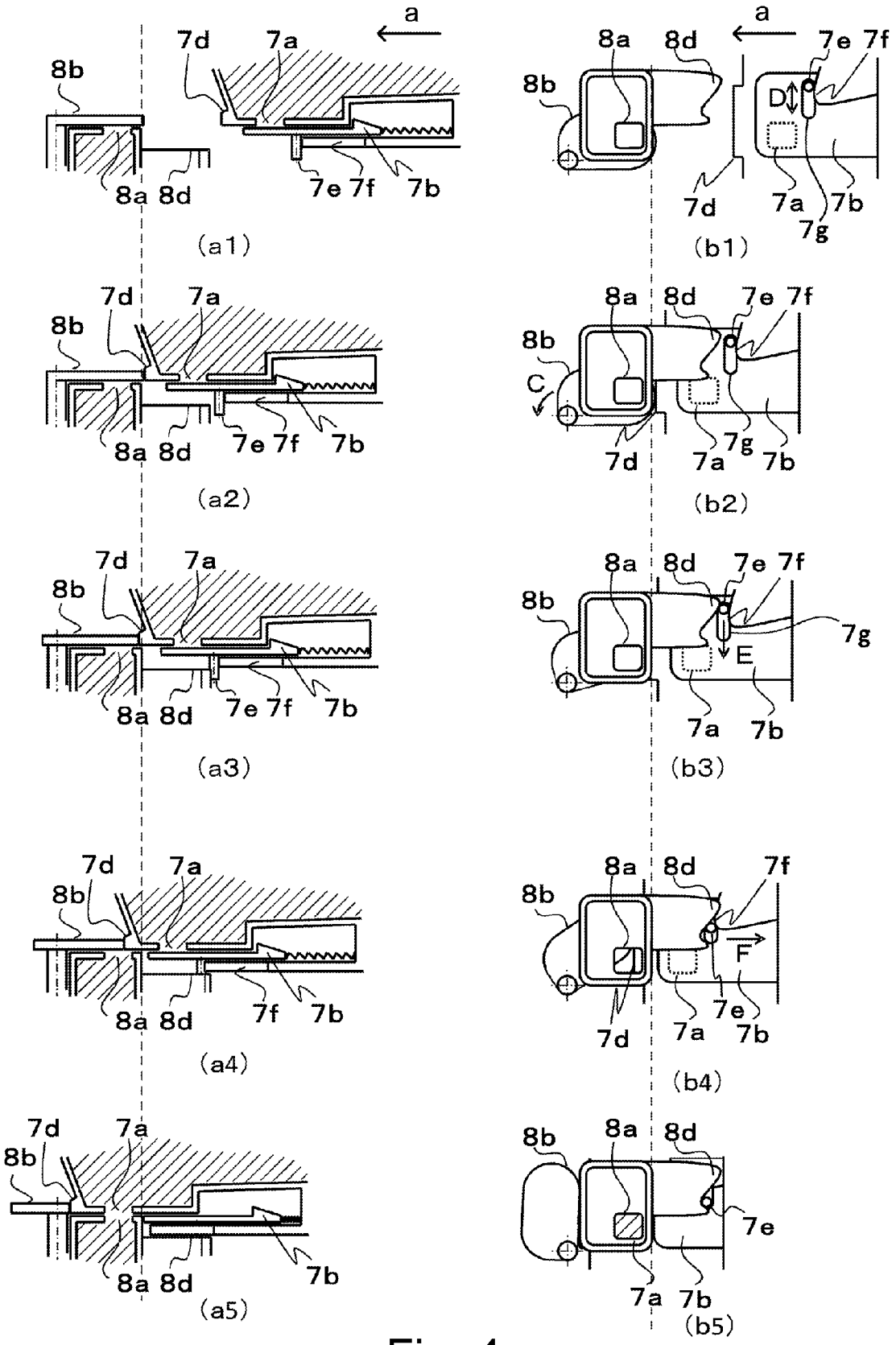
In FIGS. 4, (a1) to (a5) and (b1) to (b5) are schematic views for illustrating an opening operation of each of shutters.
Figure 5:
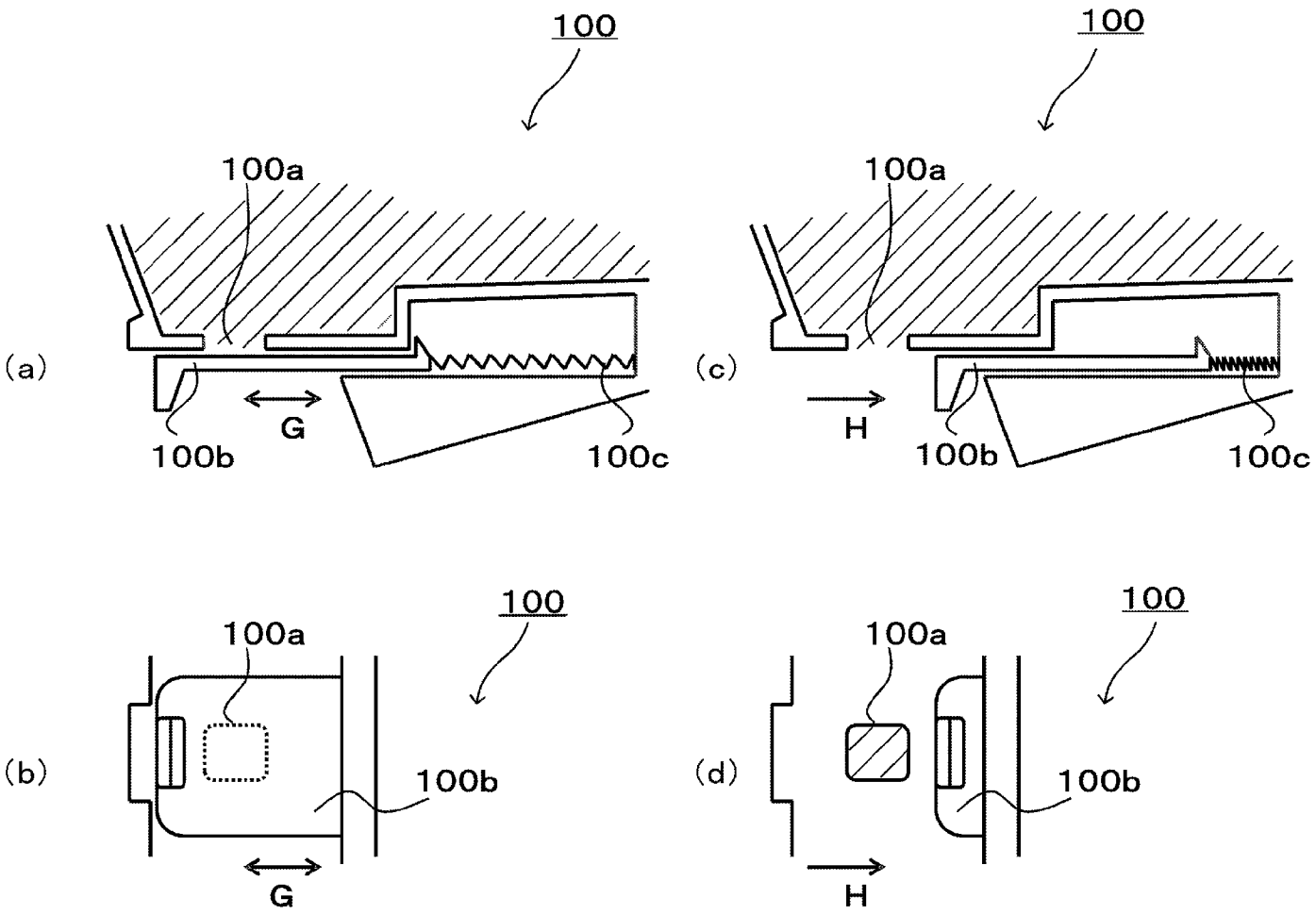
In FIG. 5, (a) to (d) are schematic views for illustrating open and closed states of a shutter of a conventional toner container.

Next, a process of the opening operation of each of the shutters will be described with reference to FIG. 4. In FIG. 4, (a1) to (a5) and (b1) to (b5) are schematic views for illustrating the opening operation of each of the shutters. In FIG. 4, (a1) to (a5) are schematic partial sectional views showing a process in which the toner container 7 is mounted on the drum container 8, and (b1) to (b5) are schematic partial bottom view showing the mounting process of the toner container 7 on the drum container 8.

First, the opening operation of the drum container shutter 8*b* will be described.

In FIG. 4, (a1) and (b1) show a state, before the toner container 7 is mounted on the drum container 8, in which the toner container 7 and the drum container 8 are spaced from each other. In FIG. 4, (a2) and (b2) show a state in which the toner container 7 is moved from the state of (a1) and (b1) of FIG. 4 in a direction in which the toner container approaches the drum container 8, thus causing the toner container 7 to contact the drum container 8.

When the toner container 7 is further moved from the state of (a2) and (b2) of FIG. 4, so that the shutter contact portion 7*d* urges the drum container shutter 8*b*, the drum container shutter 8*b* is rotationally moved in an arrow C direction in (b2) of FIG. 4 against an urging force for urging the drum container shutter 8*b*. Then, with this rotational movement of the drum container shutter 8*b*, as shown in (a3), (a4), (b3) and (b4) of FIG. 4, the drum container receiving opening 8*a* is gradually opened. Then, when the mounting of the toner container 7 on the drum container 8 is finally completed, as shown in (a5) and (b5) of FIG. 4, the opening operation of the process cartridge shutter 8*b* is completed and thus the drum container receiving opening 8*a* is placed in an open state.

Next, the opening operation of the toner container shutter 7*b* will be described.

A shutter constitution (structure) of this toner container shutter 7*b* is a characteristic feature of the present invention in this embodiment. As shown in FIG. 4, the toner container shutter 7*b* is provided with a toner container shutter boss 7*e* as a projection and a slit 7*g*. The toner container shutter boss 7*e* is held movable along and in the slit 7*g*, and is also urged by an unshown urging means at a position shown in (b1) of FIG. 4 in the non-mounted state of the toner container 7. In this embodiment, the slit 7*g* is constituted so as to extend in a direction (arrow D direction in (b1) of FIG. 4) perpendicular to a mounting and demounting direction of the toner container 7.

Further, the toner container 7 is provided with a toner container shutter guiding rib (guiding portion) 7*f* for guiding the toner container shutter boss (projection) 7*e* in contact with the toner container shutter boss 7*e*. On the other hand, the drum container 7 is provided with the shutter contact rib 7*d* contactable to the toner container shutter boss 7*e* in the mounting process of the toner container 7. The toner container shutter guiding rib 7*f* limits movement of the toner container shutter boss 7*e* in a direction opposite to the mounting direction (arrow a direction in (a1) and (b1) of FIG. 4) of the toner container 7.

In the toner container 7 mounting process, the toner container shutter boss 7*e* is urged in a direction (pushing direction) opposite to the mounting direction (the arrow a direction) by the shutter contact rib 8*d*. At this time, the toner container shutter boss 7*e* receives a pushing force in the pushing direction. Then, as shown in (b3) of FIG. 4, the toner container shutter boss 7*e* is sandwiched between the shutter contact rib 8*d* and the toner container shutter guiding rib 7*f* to receive a force exerted in an arrow E direction of (b3) of FIG. 4. This is because a contact portion of the shutter contact rib 8*d* with the toner container shutter boss 7*e* has an inclined shape with respect to the mounting direction (the arrow a direction). The shutter contact rib 8*d* has such a shape, whereby with respect to the toner container shutter boss 7*e* in the sandwiched state, it is possible to generate a component of the pushing force in the direction (arrow E direction) perpendicular to the mounting direction. Such a component of the pushing force acts on the toner container shutter boss 7*e*, and therefore the toner container shutter boss 7*e* is moved along the slit 7*g* in the toner container shutter 7*b* in a direction (arrow E direction) different from the pushing direction.

In this process, the toner container shutter boss 7*e* is only moved in the toner container shutter 7*b*, and therefore the toner container shutter 7*b* itself is not subjected to the opening, so that the toner container supply opening 7*a* is not opened.

Further, when the mounting process of the toner container 7 is further advanced, the toner container shutter boss 7*e* is moved in the slit 7*g* in the arrow E direction to a position where limitation of the movement of the toner container shutter boss 7*e* by the toner container shutter guiding rib 7*f* in the opposite direction to the mounting direction (arrow a direction) is eliminated. When the limitation of the movement of the toner container shutter boss 7*e* by the toner container shutter guiding rib 7*f* in the opposite direction to the mounting direction is eliminated, the toner container shutter boss 7*e* receives a force exerted in only the opposite direction to the mounting direction of the toner container 7 by the pushing force of the shutter contact rib 8*d*. That is, the toner container shutter boss 7*e* is moved in the pushing direction by receiving the pushing force exerted in the pushing direction (arrow F direction in (b4) of FIG. 4).

By the pushing force exerted in the opposite direction (the arrow F direction in (b4) of FIG. 4), via the toner container shutter boss 7*e*, the toner container shutter 7*b* is moved against the pushing force of the toner container shutter spring 7*c*, thus being subjected to the opening operation in the arrow F direction. Then, when the toner container 7 is mounted on the drum container 8 (mounted state), the opening operation is completed, so that the toner container supply opening 7*a* is exposed (open).

As described above, in the process of mounting the toner container 7 on the drum container 8, each of the shutters is subjected to the opening operation, and the toner feeding path from the toner container supply opening 7*a* to the drum container receiving opening 8*a* is formed, so that a state in which the toner is suppliable from the toner container 7 to the drum container 8 is created.

In this way, in a state in which the toner container 7 is demounted from the apparatus main assembly 1 alone, even when the force acts in the direction in which the toner container shutter 7*b* opens, the opening operation is limited by the contact of the toner container shutter boss 7*e* with the toner container shutter guiding rib 7*f*. That is, in this embodiment, in order to subject the toner container shutter 7*b* to the opening operation, there is a need to perform an operation with respect to two directions consisting of the direction (arrow F direction) in which the toner container shutter 7*b* opens and the direction (arrow E direction) different from the arrow F direction. For this reason, e.g., even in the case where the toner container 7 erroneously falls during transportation and thus the force is applied to the toner container shutter 7*b*, there is a low possibility that the toner container shutter 7*b* is subjected to the opening operation, so that it becomes possible to suppress the toner leakage. On the other hand, as described above, in this embodiment, when the toner container 7 is mounted on the drum container 8, the operation of the toner container shutter 7*b* can be properly completed only by mounting the toner container 7 simply in one direction.

Incidentally, in this embodiment, as the shutter opening operation, there is a need to perform the operation with respect to the two directions. However, even when the operation includes an operation with respect to two or more (a plurality of) directions different from the pushing direction, the effect in this embodiment can be similarly obtained. That is, a constitution in which the toner container shutter boss 7*e* is moved in the two or more directions different from the pushing direction and thereafter is moved in the pushing direction may also be employed. Further, also when a constitution in which the movement of the toner container shutter boss 7*e* in the direction different from the pushing direction is rotational movement and thereafter the toner container shutter boss 7*e* is linearly moved in the pushing direction is employed, a similar effect can be achieved.

Further, in this embodiment, the constitution in which the pushing direction (arrow F direction) and the direction (arrow E direction) different from the pushing direction are perpendicular to each other is employed, but the present invention is not limited thereto. It is possible to obtain an effect similar to the effect of the present invention when an angle formed between the pushing direction and the direction different from the pushing direction is 70 degrees or more and 110 degrees or less.

Incidentally, the characteristic constitution of the present invention is employed with respect to the toner container 7 as the developer container contained in the toner supply cartridge T, but may also be applied to the drum container 8 contained in the developing device D. That is, a constitution corresponding to the toner container shutter (including the slit, the toner container shutter boss and the toner container shutter guiding rib) in this embodiment may also be employed in the drum container 8 as the developer container. Further, in this embodiment, an opening shutter mechanism for feeding the toner from the toner container 7 to the drum container 8 was described. However, the present invention is not limited thereto. For example, the characteristic constitution may also be applied to other opening shutter mechanisms for feeding the toner from the toner container 7 to other containers such as a residual toner container.

According to the present invention, it is possible to provide the developer container having the shutter constitution capable of suppressing the leakage of the developer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 110783/2013 filed May 27, 2013, which is hereby incorporated by reference.

What is claimed is:

1. A developer container comprising:

an accommodating portion accommodating developer and being provided with an opening through which the developer is passable;

a shutter member for opening and closing the opening;

a projection for moving said shutter member; and a guiding portion for guiding said projection, wherein, when said projection is pushed in a pushing direction, said projection is moved in a direction different from both the pushing direction and a projecting direction of the projection, said projection being guided by said guiding portion and in contact with said guiding portion, and thereafter, said projection is moved in the pushing direction, thereby moving said shutter member to open the opening.

2. The developer container according to claim 1, wherein said shutter member has a slit formed therein, wherein the slit extends in the direction different from the pushing direction, and wherein said projection is movable in the slit along the slit.

3. The developer container according to claim 1, wherein said shutter member has a slit formed therein, and wherein said shutter member is provided with said projection movable in the slit.

4. The developer container according to claim 1, wherein an angle formed between the pushing direction and the direction different from the pushing direction is 70 degrees or more and 110 degrees or less.

5. The developer container according to claim 1, wherein the pushing direction and the direction different from the pushing direction are perpendicular to each other.

6. The developer container according to claim 1, wherein movement in the direction different from the pushing direction is rotational movement.

7. The developer container according to claim 1, wherein said projection is moved in two or more directions different from the pushing direction and thereafter is moved in the pushing direction.

8. The developer container according to claim 1, wherein said guiding portion is configured to limit movement of said projection in the pushing direction by contact with said projection and is configured to eliminate limitation of the movement of said projection in the pushing direction by the movement of said projection in the direction different from the pushing direction.

9. A developing device detachably mountable to a main assembly of an image forming apparatus, said developing device comprising:

the developer container according to claim 1, wherein the developer is supplied from a developer supply cartridge having a contact portion for pushing said projection by contacting said projection.

10. A developer supply cartridge detachably mountable to a main assembly of an image forming apparatus, said developer supply cartridge comprising:

the developer container according to claim 1, wherein the accommodated developer is supplied to a developing device having a contact portion for pushing said projection by contacting said projection.

11. A process cartridge detachably mountable to a main assembly of an image forming apparatus, said process cartridge comprising:

process means for performing an image forming process;

an image bearing member for bearing a latent image; and the developer container according to claim 1.

12. An image forming apparatus for forming an image on a recording material with a developer, said image forming apparatus comprising:

an image bearing member for bearing a latent image; and the developer container according to claim 1 detachably mountable to said image forming apparatus.

* * * * *